US006326069B1

(12) United States Patent
Barnett et al.

(10) Patent No.: US 6,326,069 B1
(45) Date of Patent: Dec. 4, 2001

(54) FLUID SAMPLER POUCH WITH INTERNAL SUPPORTIVE STRUCTURE

(75) Inventors: Roger Barnett, New York, NY (US); Steven Jeffrey Greenland, Hixson, TN (US)

(73) Assignee: Arcade, Inc., Chattanooga, TN (US)

( * ) Notice: Subject to any disclaimer, the term of this patent is extended or adjusted under 35 U.S.C. 154(b) by 0 days.

(21) Appl. No.: 08/874,424

(22) Filed: Jun. 13, 1997

(51) Int. Cl.[7] ..... B32B 3/10; B32B 15/08; B65D 81/02; B65D 85/16

(52) U.S. Cl. ..... 428/35.7; 428/35.8; 428/68; 206/229; 206/484; 206/484.2; 206/581; 206/823; 206/828

(58) Field of Search ..... 428/35.7, 35.8, 428/68; 206/581, 484, 484.2, 823, 828, 229, 733, 744, 81; 422/61, 102, 104

(56) References Cited

U.S. PATENT DOCUMENTS

| | | | | |
|---|---|---|---|---|
| 2,565,887 | * | 8/1951 | Salfisberg | 206/56 |
| 2,615,754 | * | 10/1952 | Lindenberg | 299/24 |
| 3,386,793 | * | 6/1968 | Stanton | 401/132 |
| 3,575,345 | | 4/1971 | Buck, Jr. | 239/34 |
| 3,685,734 | | 8/1972 | Paciorek et al. | 239/56 |
| 3,860,348 | * | 1/1975 | Dotle | 401/6 |
| 3,879,492 | | 4/1975 | Bontinick | 260/857 D |
| 3,913,789 | | 10/1975 | Miller | 222/107 |
| 3,917,116 | | 11/1975 | Mason | 222/92 |
| 3,921,802 | * | 11/1975 | Thompson | 206/225 |
| 3,938,659 | | 2/1976 | Wardwell | 206/439 |
| 3,995,739 | | 12/1976 | Tasch et al. | 206/484 |
| 4,094,119 | | 6/1978 | Sullivan | 53/400 |
| 4,252,846 | | 2/1981 | Romesberg et al. | 428/35.2 |
| 4,277,024 | * | 7/1981 | Spector | 239/36 |
| 4,279,344 | | 7/1981 | Holloway, Jr. | 229/123.1 |
| 4,283,011 | | 8/1981 | Spector | 239/36 |
| 4,372,098 | * | 2/1983 | Mason | 53/412 |
| 4,594,835 | * | 6/1986 | Gray | 53/433 |
| 4,747,782 | | 5/1988 | Campbell, Jr. | 434/377 |
| 4,797,309 | | 1/1989 | Kammerer et al. | 428/35.3 |
| 4,868,027 | | 9/1989 | Hunkeler et al. | 428/42.3 |
| 4,896,768 | * | 1/1990 | Anderson | 206/210 |
| 4,908,252 | | 3/1990 | Carnahan et al. | 428/27 |
| 4,998,621 | | 3/1991 | Meehan | 206/466 |
| 5,161,688 | | 11/1992 | Muchin | 206/484 |
| 5,391,420 | | 2/1995 | Bootman et al. | 428/195 |
| 5,395,047 | | 3/1995 | Pendergrass, Jr. | 239/56 |
| 5,407,358 | | 4/1995 | Gruber | 433/141 |
| 5,439,172 | * | 8/1995 | Comyn et al. | 239/34 |
| 5,445,821 | | 8/1995 | Brown et al. | 424/401 |
| 5,503,332 | | 4/1996 | Glenn | 239/56 |
| 5,534,105 | | 7/1996 | Boyd | 156/324 |
| 5,535,885 | | 7/1996 | Daniel et al. | 206/484 |
| 5,622,263 | | 4/1997 | Greenland | 206/581 |
| 5,637,401 | * | 6/1997 | Berman et al. | 252/315.2 |
| 5,645,161 | | 7/1997 | Whitaker et al. | 206/484 |
| 5,879,769 | | 3/1999 | Greenland et al. | 428/35.7 |

FOREIGN PATENT DOCUMENTS

| | | |
|---|---|---|
| 35 08 445 | 9/1986 | (DE) . |
| 197 09 110 | 9/1998 | (DE) . |
| 2 599 716 | 12/1987 | (FR) . |

* cited by examiner

*Primary Examiner*—Harold Pyon
*Assistant Examiner*—Sandra M. Nolan
(74) *Attorney, Agent, or Firm*—Pennie & Edmonds LLP

(57) ABSTRACT

A sampler pouch having a lower barrier layer; an upper barrier layer peelably sealed to the lower barrier layer to form a cavity; and a fluidic sample material absorbed within an internal supportive structure within the cavity. The internal supportive structure is inert and substantially retains the sample material when subjected to compressive forces, thereby reducing internal pressure against the peel seal and allowing for the use of low strength peel seals.

18 Claims, 1 Drawing Sheet

FLUID SAMPLER POUCH WITH INTERNAL SUPPORTIVE STRUCTURE

FIELD OF THE INVENTION

The present invention relates generally to a sampler and more specifically to a sampler pouch comprising two layers of material peelably sealed to form a pouch which contains a fluid sample and a core material. The core, which is inert and compression resistant, absorbs and substantially retains the sample material. The core also serves as an internal supportive structure that provides resistance to compressive forces thereby preventing rupture of the pouch.

BACKGROUND OF THE INVENTION

Product samplers constructed of flexible barrier materials are routinely used to package and distribute small quantities of liquid cosmetic, fragrance, or medical formulations. Such samplers are generally distributed without cost to the consumer as a product sample. Though distribution methods vary, a substantial majority of manufacturers have their samples distributed to the household. Such samples are most commonly distributed through inclusion with printed media such as newspapers and magazines. The samples may also be distributed as a direct mail solicitation sent directly to prospective customers.

When these distribution methods are used, the sampler is routinely subjected to substantial compressive forces that may result in package failure due to rupture. A sample package offered for media distribution must also endure forces exerted by bindery equipment such as high pressure clamps, rollers, and the like. Printed media is frequently bundled, strapped, and stacked for transportation, thereby subjecting the samplers to further compressive forces. Additionally, samplers distributed by direct mail are subjected to driven nip rollers that are typical to automated handling.

The variety and magnitude of forces exerted on the sample require substantial minimum package performance requirements. Therefore, the selection of materials for sampler construction is generally limited to those that produce the strongest hermetic heat seals. One such pouch sampler containing 1.5 milliliters of "Max Factor-High Definition Perfecting makeup" was tested and found to resist over 3,000 pounds of compressive force. The tensile strength of the heat seals was measured when pulled apart at 180 degrees @12 inches per minute travel according to TAPPI T-494 (Technical Association of the Pulp and Paper industry) and found to be in the range of 16 to 18 pounds per linear inch. Sample pouches constructed of such materials normally require the use of scissors or knife to open. The above referenced sample was printed with a diagonal dotted line across one corner the instructions "cut here". Alternately, a cut or notch may be provided in the perimeter seal in order that the pouch may be torn open. Heavy pouch laminates do not tear easily, however, and considerable force may be required to open the sample package. Should the sample material be a low viscosity fluid, the consumer is likely to spill the contents while opening the package. Additionally, the sample material may not be examined prior to dispensing.

Known devices of this type also include samplers that contain a folded "towelette" that is saturated with a liquid product sample. For example, U.S. Pat. No. 2,565,887 to Salfisburg describes such a sampler. These samplers are commonly used for materials such as cleaning agents and fragrances. The towelette functions as an applicator and also guards against accidental spillage when the sampler is cut or torn open. The Salfisburg package also restricts the user's ability to preview the contents without removing the towelette.

Further, prior art samplers also include those that incorporate easy-open "peel seals". Such a sampler for liquid fragrance is disclosed in U.S. Pat. No. 5,391,420 to Bootman et al. The sampler disclosed in Bootman includes a perfume-doped layer, such as a polymer gel or a U.V. curable oligomer, carried between two barrier members. This perfume-doped layer carries the fragrance. However, it does not function as an internal support to the sampler.

The seal strengths of the Bootman sampler have been measured at below 3.0 pounds per linear inch (TAPPI T-494 modified as above). However, in lieu of a support or reinforcement structure to prevent sampler failure due to rupture, the fluid volume of the sampler is substantially restricted./ At most, the Bootman sampler can deliver only 25 microliters per square inch of package interior as measured in two dimensions. Although the surface area of the barrier members forming the pouch label may be increased in order to deliver greater quantities of fragrance, spreading the fragrance over increasingly large surface areas may adversely affect the stability of the product. The Bootman sampler also lacks effective means for the user to apply the sample material.

In addition, U.S. Pat. No. 4,998,621 to Meehan teaches a sampler for fluids in the form of a peelable pouch. The inventor recognized the vulnerability of the peelable pouch design to failure and so teaches the need for a protective external carrier to protect it from compressive forces. The Meehan sampler requires a multi-step manufacturing process that negatively contributes to the cost. In addition, Meehan fails to address the problem of accidental spillage which may occur upon opening the Meehan sampler, nor does the Meehan sampler provide a means of applying the sample material.

Finally, U.S. Pat. No. 5,622,263 to Greenland teaches a three dimensional hermetically sealed sampler with an easy-open peel seal. The invention also teaches the need for protecting the peel seal from compressive forces which could lead to pressure induced rupture. The thermoplastic sidewall of the sampler functions as an external load bearing structural member, and it also limits spillage. However, this sampler also fails to provide a means of applying the sample material.

As above described, there is room for improvement within the known art. An objective of the present invention is to provide an improved sampler that addresses and substantially overcomes the shortcomings of the known prior art samplers.

A more specific objective of the present invention is to provide an easy-open flexible barrier sampler pouch that provides significant resistance from failure due to compressive pressures or forces.

A further objective of the present invention is to provide a sampler pouch that provides a means for previewing the contents without actually using or dispensing the sample.

Another objective is to provide a sampler pouch with a spill resistant design.

Yet another objective is to provide a sampler pouch which includes a sample application device, which is integrated with the overall sampler pouch design and provides a compression resistant internal structure.

SUMMARY OF THE INVENTION

The present invention relates to a sampler pouch comprising four major elements: a lower barrier layer; an upper barrier layer sealed to the lower barrier layer forming a fluid tight cavity; and a fluidic sample material absorbed within an internal supportive structure within the cavity. The internal supportive structure allows the design of this sampler pouch to include an easy-open peel seal without compromising the integrity of the sampler pouch and its resistance to mechanical failure such as bursting or rupture. The sample material comprises low to medium viscosity liquids, including fragrances, cosmetics, personal care products, and medical treatments or formulations.

The present invention also relates to a sampler pouch comprising a lower barrier layer; an upper barrier layer; a peel seal attaching the lower barrier layer to the upper barrier layer and thereby forming a fluid tight cavity; and a core within the cavity which absorbs a sample material. This core substantially retains the sample material under compressive pressure.

In addition, the present invention relates to a sampler pouch having an internal supportive core which also serves as a user friendly applicator of the sample material.

BRIEF DESCRIPTION OF THE DRAWINGS

Reference is next made to a brief description of the drawings, which are intended to illustrate the sampler pouch according to the present invention. The drawings and detailed description which follows are intended to define the scope of the invention as set forth in the appended claims.

DETAILED DESCRIPTION OF THE SAMPLER POUCH

Figure 1:
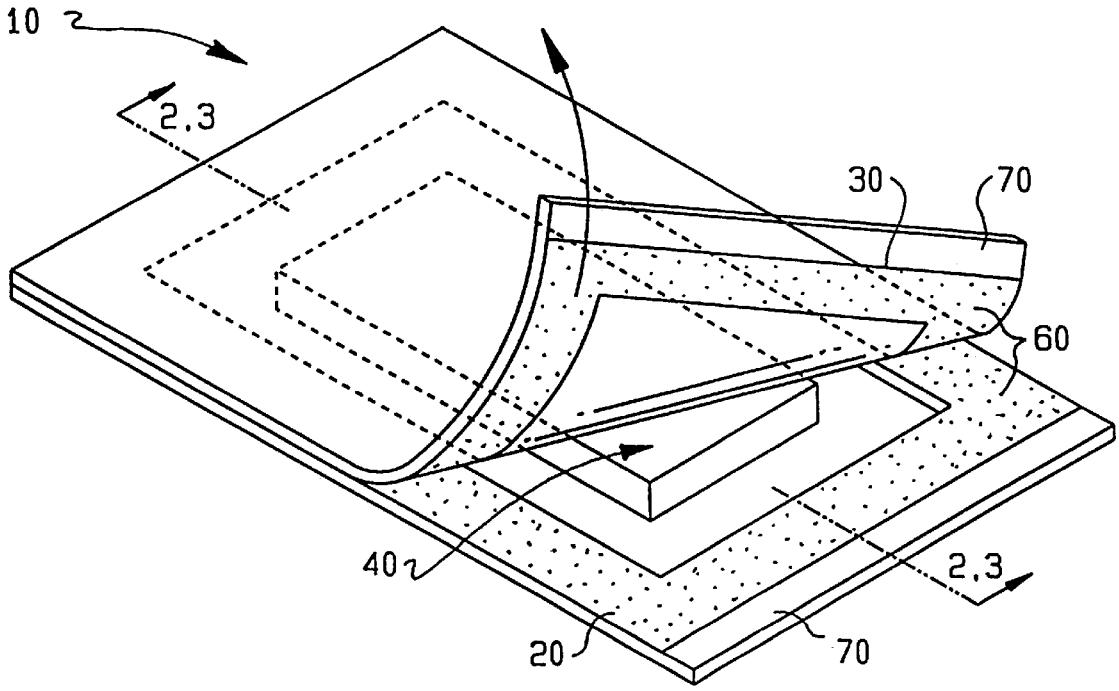
FIG. 1 illustrates a sampler pouch according to the present invention which has been partially peeled apart.
Figure 2:
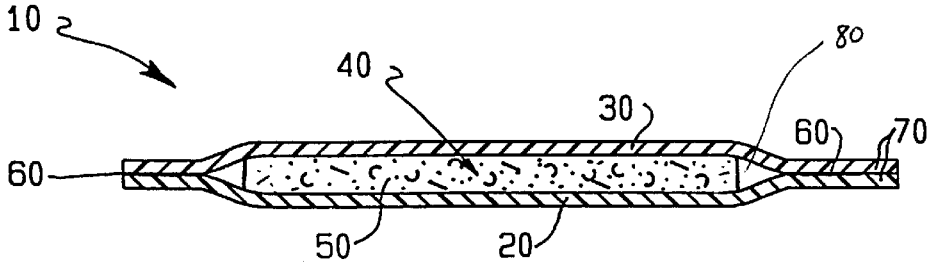
FIG. 2 is a cross sectional view of the sampler pouch illustrated in FIG. 1, taken along line 2—2 of FIG. 1.
Figure 3:
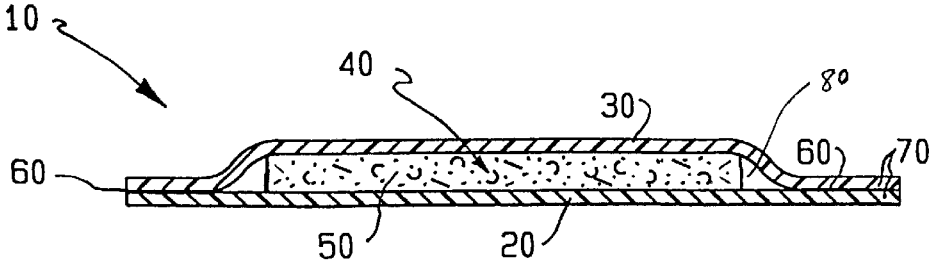
FIG. 3 is a cross sectional view of an alternative embodiment of the sampler pouch, with a semi-rigid bottom layer, taken along line 3—3 of FIG. 1.

Referring more particularly to the drawing, FIGS. 1–3 represent a sampler pouch 10. As shown in FIG. 1, the sampler pouch 10 comprises a lower barrier layer 20, an upper barrier layer 30, and a core 40 that absorbs a fluidic sample material 50 and substantially retains said sample material 50. A peel seal 60 joins the upper and lower layers, thus forming a sealed compartment or cavity 80 (shown in FIGS. 2 and 3) for holding the core 40 and sample material 50. At least one of the layers 20, 30 is constructed of a flexible barrier material. As shown in FIG. 3, one of the barrier layers 20, 30 may comprise a semi-rigid material.

The sample material 50 comprises a low to medium viscosity liquid, which is preferably a fragrance or cosmetic. In addition to fragrances and cosmetics, the contained sample material 50 may be any of a wide variety of materials, including personal care products and medical treatments. Cavity 80 contains anywhere from around 25 milligrams to around 150 milligrams of sample material 50 per square inch within cavity 80.

The user accesses the core 40 and sample material 50 absorbed therein by peeling apart the upper layer 30 from the lower layer 20. Thy upper and lower barrier layers 30, 20 extend beyond the area of cavity 80 and peel seal 60 in an area defining peel tab 70 to enable the user to initiate peeling. Unlike much of the prior art, neither scissors nor a tear notch is required to open the sampler pouch 10. Peel seal 60 has a seal strength in the range of 0.25 to 3.50 pounds per linear inch of seal when pulled apart at 180 degrees at 12 inches per minute travel rate (TAPPI T-494 modified). More preferably the seal strength is in the range of 1.25 to 2.00 pounds per linear inch. In addition peel seal 60 can withstand compressive forces from around 500 pounds to around 5,00 pounds. More preferably, peel seal 60 can withstand compressive forces from around 1,000 pounds to around 4,500 pounds.

Peel seal 60 may be formed by any appropriate method known in the art. For example, peel seal 60 may comprise a heat seal or melt bonded relationship. Alternatively, peel seal 60 may be formed with an appropriate adhesive. Peel seal 60 may also be resealable, thereby allowing a user to reclose the sampler pouch 10 and store it for later use.

Core 40 is a multi-functional component. One purpose of the core 40 is to serve as an internal supportive structure intended to support loads when the sampler is stacked alone or in combination with printed materials. The internal support afforded by the core 40 prevents or alleviates hydraulic pressure which may build within the cavity 80 when a planar compressive force is exerted on the sampler. Otherwise, internal hydraulic forces acting on the easy-open peel seal 60 would rupture the sampler pouch 10.

Another function of the core 40 is to generally confine the sample material 50 in a well defined area. This is not only more aesthetically appealing to the consumer, but it also allows the peel seal 60 to be properly formed during manufacture of the sampler and prevents rapid spreading and diffusion of the sample material 50. Low viscosity materials such as fragrances are particularly prone to such spreading and diffusion, and this will contaminate the peel seal area.

In addition, because the sample material 50 is absorbed into the core 40, one or both of the flexible barrier layers 20, 30 may be conformed closely to the core 40, thereby reducing or eliminating air within the cavity 80. The reduction of air within the cavity 80 further increases the sampler's resistance to pressure induced rupture and lengthens the usable shelf life of the sample material 50.

Yet another function of the core 40 is to loosely bind the fluid sample material 50 as the sampler pouch 10 is peeled open. Therefore, a consumer may view or smell the sample material 50 before actual application. This design also prevents spillage. The core 40 additionally functions as an applicator for applying the sample material 50. The core 40 may be rubbed on the skin, thereby releasing sample material 50 in a well controlled fashion.

The core 40 may be made of a number of readily available materials that provide the requisite characteristics. The material must be chemically inert so as not to react with the sample material 50. Further, the core 40 must be able to absorb and hold enough sample material 50 to allow the user to receive the full impression or effect of the sample material 50. Additionally, the core 40 must resist collapse of its planar profile under a large range of compressive loads and at the same time substantially retain the absorbed sample material 50. Finally, the core 40 should have a surface appealingly soft to the touch for use as an applicator.

The preferred material for the lower and upper barrier layers 20, 30 is a heat sealable, flexible, foil bearing plastic barrier laminate. At least one of the lower or upper layers 20, 30 is preferably constructed with a peelable olefin sealant layer of the type described in U.S. Pat. No. 3,879,492 to Botnick. This material is sold under the trade name "Rayopeel". When heat sealed to itself or to a compatible non-peelable olefin film, the film forms peelable hermetic seals having a seal strength in the range of 1.0 to 2.5 pounds per linear inch. The present invention is not limited to the above specified seal strength, but must be low enough to allow the user to peel open the sampler without the need for scissors, a tear notch, or tear string. The preferred upper and lower layers of the pouch are layered structures with outermost layers furthest from the sample material 50. A complete preferred structure from outermost layer inward is as follows: 48 gage biaxially oriented polyester film / adhesive / 0.0030 inch aluminum foil / adhesive 1 40–50 microns "Rayopeel-R" co-extruded olefin film. Both the lower and upper layers 20, 30 may comprise this preferred structure.

In other embodiments the lower or upper barrier layers 20, 30 may be alternately constructed of such materials as biaxially oriented polyester film; polypropylene film; high density polyethylene film; "Barrex" acrylonitrile co-polymer film; cast PET or PETG film; aluminum foil; PVDC film; co-extruded films containing EVOH; PVA film; polyamide film; vinyl film; or composite laminations or coatings that contain the same.

In the preferred embodiment, the peel seal 60 is a hermetic bond between the confronting inner thermoplastic surfaces of the lower and upper barrier layers 20, 30 effected by the application of heat and pressure from without. In the preferred embodiment, the peel seal 60 functions through the use of a cohesively rupturing thermoplastic film. As mentioned above, although the preferred embodiments described above utilize thermoplastic heat sealable materials to achieve the peel seal 60, the peel seal may also be achieved by the selective application of suitable adhesive systems to the confronting inner surfaces of either the lower or upper barrier layers 20, 30. The cavity 80 formed by sealing the lower and upper barrier layers 20, 30 by means of peel seal 60 must; provide nearly a complete barrier to the sample material 50. In other words, it should be substantially fluid tight.

In a first alternate embodiment shown in FIG. 3, the lower layer 20 is formed from a semi-rigid, foil bearing laminate structure. Such a laminate structure from outermost layer inward is a follows: 9 point SBS bleach board / 7 lb. per ream Polyethylene extrusion tie layer / 0.0030 aluminum foil primer / 22 pounds per ream polyethylene extrusion coating.

In another alternative embodiment, the lower layer 20 may be coated with a pressure sensitive adhesive on its outer surface, further covered by a siliconized release liner. This embodiment facilitates attachment of the sampler pouch 10 to an appropriate advertising carrier, such as a magazine page, "blow in" card or magazine insert.

In the preferred embodiment, the core 40 is constructed with a non-woven, thermally bonded polypropylene fiber web with a basis weight in the range of 35 to 100 grams per square yard. This material is available from Veratec Division of International Paper Co. and sold under the trade name "Spunbond". Alternatively, the core 40 may be formed from woven or non-woven fiber webs of polyester, rayon, cellulose, cotton, polyethylene, nylon, or composites of the above. Other materials may also be utilized provided they meet the required characteristics without departing from the spirit of the invention.

What is claimed:

1. A fluid sampler pouch comprising:

a lower barrier layer;

an upper barrier layer;

a peel seal attaching the lower barrier layer to the upper barrier layer, thereby forming a fluid tight cavity;

an internal supportive structure within the cavity, wherein the internal supportive structure enables the peel seal to withstand compressive forces from around 500 pounds to around 5,000 pounds; and a fluidic sample material absorbed within the internal supportive structure, wherein the fluidic sample material is a material that is to be applied as a liquid directly to skin.

2. The fluid sampler pouch of claim 1, wherein the peel seal has a seal strength in the range from around 0.25 to around 3.50 pounds per linear inch of seal when the barrier layers are pulled apart at 180°.

3. The fluid sampler pouch of claim 2, wherein the peel seal has a seal strength in the range from around 1.25 to around 2.00 pounds per linear inch of seal when the barrier layers are pulled apart at 180°.

4. The fluid sampler pouch of claim 1, wherein the volume of contained sample material is from around 25 mg to around 150 mg per planar square inch within the cavity.

5. The fluid sampler pouch of claim 1, wherein the peel seal can withstand compressive forces from around 1,000 pounds to around 4,500 pounds.

6. The fluid sampler pouch according to claim 1, wherein the internal supportive structure comprises a non-woven polypropylene fiber web.

7. The fluid sampler pouch according to claim 1, wherein one of the upper and lower barrier layers is a semi-rigid material.

8. The fluid sampler pouch according to claim 1, wherein the sample material comprises a fragrance.

9. The fluid sampler pouch according to claim 1, wherein the sample material comprises a cosmetic.

10. The fluid sampler pouch according to claim 1, wherein the sample material comprises a medication.

11. The fluid sampler pouch according to claim 1, wherein the internal supportive structure comprises a surface and wherein the internal supportive structure releases sample material when the surface of the internal supportive structure is rubbed.

12. A fluid sampler pouch comprising:

a lower barrier layer;

an upper barrier layer;

a peel seal attaching the lower barrier layer to the upper barrier layer, thereby forming a fluid tight cavity;

an internal supportive structure within the cavity, wherein the internal supportive structure enables the peel seal to withstand compressive forces from around 500 pounds to around 5,000 pounds;

a fluidic sample material absorbed within the internal supportive structure, wherein the fluidic sample material is a material that is to be applied as a liquid directly to skin; and an advertisement carrier attached to at least one of the upper and lower barrier layers.

13. The fluid sampler pouch according to claim 12, wherein the advertisement carrier comprises a magazine page.

14. The fluid sampler pouch according to claim 12, wherein the advertisement carrier comprises a card.

15. The fluid sampler pouch according to claim 12, wherein the advertisement carrier comprises a magazine insert.

16. A fluid sampler pouch comprising:

a lower barrier layer;

an upper barrier layer;

a peel seal attaching the lower barrier layer to the upper barrier layer, thereby forming a fluid tight cavity;

an internal supportive structure within the cavity, wherein the internal supportive structure enables the peel seal to withstand compressive forces from around 500 pounds to around 5,000 pounds; and a fluidic sample material absorbed within the internal supportive structure, wherein the fluidic sample material is a material that is to be applied as a liquid directly to skin;

and wherein said internal supportive structure is adapted to serve as an applicator of said sample material.

17. A fluid sampler pouch comprising:

a lower barrier layer;

an upper barrier layer;

a peel seal attaching said lower barrier layer to said upper barrier layer; said lower barrier layer and said upper barrier layer forming a cavity there between, said cavity being adjacent said peel seal;

an internal supportive structure within said cavity between said upper and lower barrier layers to prevent collapsing of said cavity and to provide resistance to the transmission of compressive forces to said peel seal whereby said pouch withstands greater compressive forces with said internal supportive structure in place within said cavity than without said internal supportive structure within said cavity; and a fluidic sample material absorbed within the internal supportive structure for use by a consumer upon breaking said peel seal wherein said fluidic sample material is to be applied directly to the skin, wherein the internal supportive structure enables the peel seal to withstand compressive forces of from about 500 pounds to about 5,000 pounds.

18. A fluid sampler pouch comprising;

a lower barrier layer;

an upper barrier layer;

a peel seal attaching said lower barrier layer to said upper barrier layer; said lower barrier layer and said upper barrier layer forming a cavity there between, said cavity being adjacent said peel seal;

an internal supportive structure having a substantially planar profile and located within said cavity between said upper and lower barrier layers to prevent collapsing of said cavity and to provide resistance to the transmission of compressive forces to said peel seal whereby said pouch withstands greater compressive forces with said internal supportive structure in place within said cavity than without said internal supportive structure within said cavity; and a fluidic sample material absorbed within the internal supportive structure for use by a consumer upon breaking said peel seal wherein said internal supportive structure is capable of substantially resisting collapse of its planar profile under compressive forces and at the same time substantially retaining the absorbed fluidic sample material wherein said fluidic sample material is to be applied directly to the skin, wherein the internal supportive structure enables the peel seal to withstand compressive forces of from about 500 pounds to about 5,000 pounds.

* * * * *